United States Patent [19]

Meyer

[11] 4,104,015

[45] Aug. 1, 1978

[54] SPINNERET ASSEMBLY

[75] Inventor: Richard D. Meyer, Greenville, S.C.

[73] Assignee: Phillips Petroleum Company, Bartlesville, Okla.

[21] Appl. No.: 758,601

[22] Filed: Jan. 11, 1977

[51] Int. Cl.[2] ..... B29F 3/04; D01D 3/00

[52] U.S. Cl. ..... 425/382.2; 264/176 F; 425/463; 425/464

[58] Field of Search ..... 264/176 F, 177 F; 425/463, 198, 382 R, 382.2; 259/4 AB

[56] References Cited

U.S. PATENT DOCUMENTS

| | | | |
|---|---|---|---|
| 2,440,761 | 5/1948 | Sisson et al. | 425/463 |
| 2,883,261 | 4/1959 | McGeorge | 264/176 F |
| 2,971,219 | 2/1961 | Hill | 425/463 |
| 3,050,774 | 8/1962 | Tait | 425/463 |
| 3,128,794 | 4/1964 | Boucher et al. | 259/4 AB |
| 3,381,336 | 5/1968 | Wells | 425/382.2 |
| 3,608,148 | 9/1971 | Sluisters | 264/171 |
| 3,799,509 | 3/1974 | Bydal | 259/4 AB |
| 3,938,925 | 2/1976 | Lees | 425/382.2 |
| 3,981,657 | 9/1976 | Orso et al. | 425/382 R |

FOREIGN PATENT DOCUMENTS

| | | | |
|---|---|---|---|
| 1,139,397 | 1/1969 | United Kingdom | 264/176 F |

*Primary Examiner*—Jay H. Woo

[57] ABSTRACT

Plug flow of a polymer through a spinneret assembly is approximated by employing an annular inlet means that initially distributes the polymer between the center and the outer wall of a spinneret assembly.

7 Claims, 5 Drawing Figures

SPINNERET ASSEMBLY

BACKGROUND OF THE INVENTION

The invention relates to a spinneret assembly and to a method for producing filaments.

Filaments of various polymeric materials such as for example, polyolefins, polyamides, polyesters, etc., are produced by feeding the polymer, which is solid and in particulate form, to a screw extruder in which the polymer is melted and extruded through a spinneret. A spinneret is essentially a plate having a plurality of orifices therein. The orifices form the molten polymer into filaments which are then cooled or quenched by a cooling medium, generally conditioned air, and then further processed as known in the art. In order to produce high quality textile products from synthetic filaments, it is important that the spinning process produce synthetic filaments having a high degree of uniformity. The present invention is primarily directed toward improving the uniformity of filaments produced by such spinning processes as previously described.

It has been suggested that one of the most significant factors contributing to filament nonuniformity during the spinning process is the fact that the temperature of the molten polymer passing through the orifices positioned near the center of the spinneret is higher as compared to the temperature of the molten polymer passing through the orifices positioned near the edge of the spinneret. The higher the temperature of the polymer the lower the viscosity and the lower the viscosity the faster the polymer under a given pressure passes through an orifice of the spinneret. Therefore, because of the temperature differential across the face of the spinneret, the flow rate of the molten polymer through the orifices of the spinneret varies which results in filament nonuniformity. Although attempts have been made to reduce the temperature differential across the face of the spinneret and thus improve the nonuniformity of the filaments, nonuniformity is still a problem.

An object of the present invention is to reduce the temperature differential across the face of spinneret, that is, the variation in the temperature of the filaments at the spinneret face beginning from the center of the spinneret and working radially outward.

Another object of the present invention is to extrude a molten polymer through a plurality of orifices simultaneously and at the same flow rate.

Still another object of the invention is to reduce the nonuniformity of filaments produced by melt spinning.

Other objects, aspects and advantages of the present invention will be apparent to those skilled in the art upon studying the specification, drawings and the appended claims.

SUMMARY OF THE INVENTION

According to the invention a spinneret assembly comprises an annular inlet means that passes a viscous fluid flowing generally in the shape of an annulus to a distribution means. The distribution means substantially uniformly distributes the fluid over the surface of a spinneret so that the fluid passing through each of the orifices of the spinneret passes through the orifices at substantially the same flow rate.

Further according to the invention, a viscous fluid is passed from an annular zone of restriction to a first distribution zone. The fluid is passed from the first distribution zone to a second distribution zone through a second zone of restriction which forces the fluid from the first distribution zone substantially uniformly to the second distribution zone. Filaments of the fluid are then formed by passing the fluid through a plurality of orifices wherein the flow rate of the fluid through each orifice is substantially the same.

The above-described spinneret assembly is useful for carrying out the method of the invention and practice of the method of the invention produces filaments having a high degree of uniformity.

DETAILED DESCRIPTION OF THE INVENTION

It has been found that the use of an annular inlet means in a spinneret assembly causes a viscous fluid, such as a molten polymer, to flow through the remainder of the spinneret assembly, including the spinneret, substantially in "plug flow". As used herein the term "plug flow" means that each of the molecules of a viscous fluid move somewhat resembling a solid mass in that they maintain their relative position to one another, thus molten polymer flowing through a spinneret assembly in "plug flow" would result in the polymer passing through the orifices of the spinneret at the same flow rate to produce highly uniform filaments.

Figure 1:
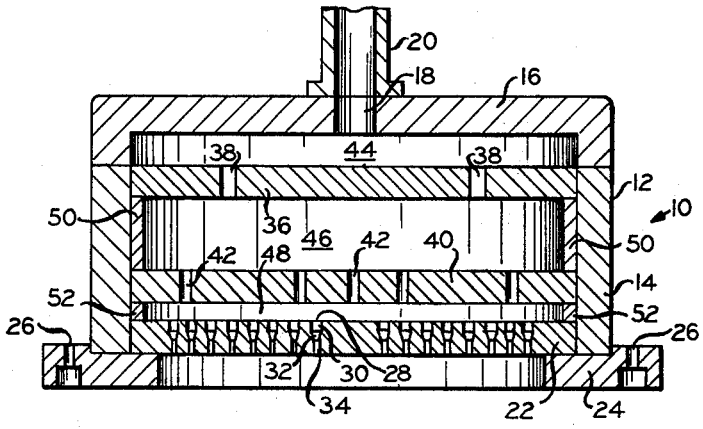
FIG. 1 is an elevation view shown in section of one embodiment of a spinneret assembly in accordance with the invention.
Figure 4:
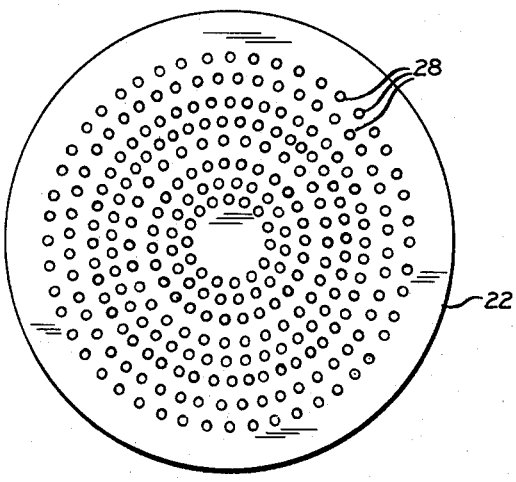
FIG. 4 is a top view of the spinneret shown in FIG. 1.

Referring to the drawing, specifically FIG. 1, spinneret assembly 10 comprises a housing 12 having side wall 14 and top 16. Top 16 has an inlet 18 positioned in the center thereof attached to pipe 20 connected to an extruder (not shown) for a source of molten polymer. A spinneret 22 is positioned on the opposite end of housing 12 from inlet 18 to form the outlet. The spinneret is secured to the housing 12 by annular ring 24 which has apertures 26 for securing the spinneret assembly to a spinning block (not shown) as known in the art. Spinneret 22 has a plurality of orifices 28 also shown in FIG. 4. Each orifice comprises an inlet portion 30, a transition portion 32 and a land portion 34.

Figure 2:
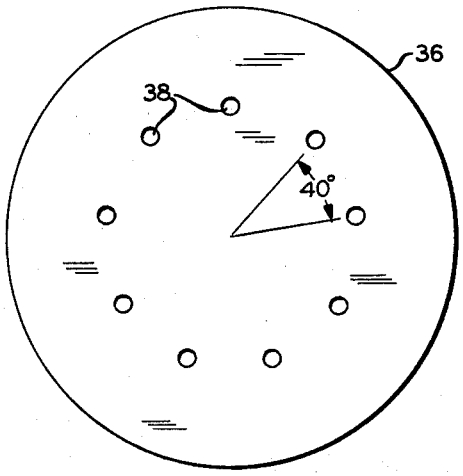
FIG. 2 is a top view of the annular inlet means shown in FIG. 1.

Positioned just below inlet 18 is an annular inlet means illustrated in this embodiment in the shape of a circular plate 36, also shown in FIG. 2, which has a plurality of orifices 38. As is shown in FIG. 2, orifices 38 are equally spaced, and the center of each orifice 38 lies on a circle the center of which coincides with the center of plate 36. In this particular embodiment the orifices are positioned 40° apart and the centers of the orifices 38 lie on a circle having a radius equal to 60 percent of the radius of plate 36.

Immediately below the annular inlet means and above spinneret 22, referring again to FIG. 1, lies a distributor means, also shown in this embodiment in the shape of a circular plate 40. Plate 40 is positioned parallel to plate 36 and spinneret 22. Plate 40 also has a plurality of orifices 42. The centers of orifices 42 are positioned on three concentric cirles. The concentric circles are equally spaced along the radius of plate 40. The orifices 42 located on any one circle are positioned 30° apart and orifices 42 positioned on adjacent circles are offset 15° so that orifices 42 are staggered.

In the operation of the spinneret assembly, a viscous fluid, such as for example a molten polymer, flows through pipe 20 and inlet 18 into an initial distribution zone 44. The fluid then flows radially outward, through orifices 38 of plate 36 as an annular zone of restriction and into a first distribution zone 46. A portion of the polymer moves toward the center of zone 46 as well as toward 14 so that the fluid flows through orifices 42 of plate 40 as a second zone of restriction and into a second distribution zone 48. Orifices 42 of plate 40 force the fluid uniformly from the first zone to the second zone. The polymer is then formed into filaments as it passes through orifices 28 from the second distribution zone 48. The polymer in the second distribution zone 48 is moving substantially in "plug flow", thus the polymer flowing through orifices 28 is flowing through each orifice at substantially the same flow rate.

Figure 5:
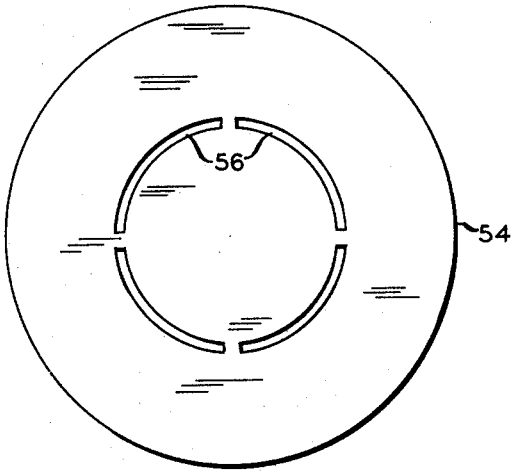
FIG. 5 is another embodiment of an annular inlet means suitable for use in the spinneret assembly of FIG. 1 in lieu of the annular inlet means shown in FIGS. 1 and 2.

The position of orifices 38 of plate 36 must be positioned so as to generally form an annulus. Where orifices are used as the passages for the fluid as previously described, generally the centers of orifices 38 are positioned on a circle having a radius range from about 25 percent to about 80 percent the length of the radius of plate 40; however, from the results of the Example hereinafter described, it is believed that good results can be obtained employing a radius ranging from about 35 to about 65 percent the length of the radius of plate 40. Obviously it is within the scope of the invention to position orifices 36 generally in the shape of a circle, although all the centers of the orifices do not lie on a single circle. In order to practice the invention, it is sufficient if the passageways for the fluid form the fluid generally in the shape of an annulus. Another embodiment of an annular inlet means suitable for use in the invention in lieu of the annular inlet means shown in FIGS. 1 and 2 is shown in FIG. 5. FIG. 5 shows a circular plate 54 having a plurality of elongated orifices 56 forming the shape of an annulus. As shown in FIG. 5, elongated orifices 56 form four discontinuous segments of an annulus. Depending upon the exact design of the equipment, an annular inlet means could be designed so that the annulus was one continuous segment; however, it is believed that it would be more economical from the equipment standpoint to design the annular inlet means having an annulus formed from at last two discontinuous segments.

Since only one circle of orifices is provided in plate 36, the height of zone 44, that is, the distance between plate 36 and top 16 of housing 12, is not particularly important and most any height of zone 44 can be used. Of course, a very small height will increase the pressure loss through zone 44, which is not generally desirable, but that does not effect the plug flow of the polymer through zone 48.

As shown in FIG. 2, orifices 38 of the first plate 36 are spaced at 40° intervals. The actual spacing can be selected over a relatively broad range, but generally the spacing ranges from about 15° to about 60°.

The position of the fluid passageways in the distribution means, such as orifices 42 in plate 40 is important in that the passageways must be positioned uniformly so that the polymer is substantially uniformly passed from the first distribution zone 46 to the second distribution zone 48. The relative position of orifices 42 in plate 40 shown in FIG. 3 and previously described, was found to be an effective arrangement of the orifice so that the polymer flowed substantially uniformly from zone 46 to zone 48.

The height of zone 46, that is, the distance between plate 36 and plate 40, which is maintained by annular ring 50, can be selected over a broad range, but usually it ranges from about ¼ inch (0.635 cm) to about 6 inches (15.24 cm). Based upon the results of the Example hereinafter described, good results can be obtained employing a distance between plates 36 and 40 ranging from about ½ inch (1.27 cm) to about 2 inches (5.08 cm).

The height of zone 48, that is, the distance between plate 40 and spinneret 22, which is maintained by annular ring 52, also can be selected over a relatively broad range, but usually it is selected from a distance ranging from about 1/16 inch (0.158 cm) to about 3 inches (7.62 cm). Based upon the results of the Example hereinafter described, good results can be obtained employing a distance between plate 40 and spinneret 28 ranging from about 3/32 inch (0.238 cm) to about 1 inch (2.54 cm).

The spinneret assembly of the present invention is useful to form filaments of most any material which is capable of existing as a viscous fluid. Generally thermoplastic polymers are employed that form viscous fluids upon heating, such as for example, polyolefins, polyamides, polyesters and poly(arylene sulfides).

As is apparent from FIGS. 2, 3, 4 and 5, the total cross-sectional area of orifices 28 in spinneret 22 is larger than the total cross-sectional area of orifices 42 in plate 4, which is larger than the total cross-sectional area of orifices 38 in plate 36 or of segments 56 of plate 54. Such a graduation of cross-sectional areas is believed to be desirable based upon the Example hereinafter described, and thus such an arrangement is preferred.

EXAMPLE

Figure 3:
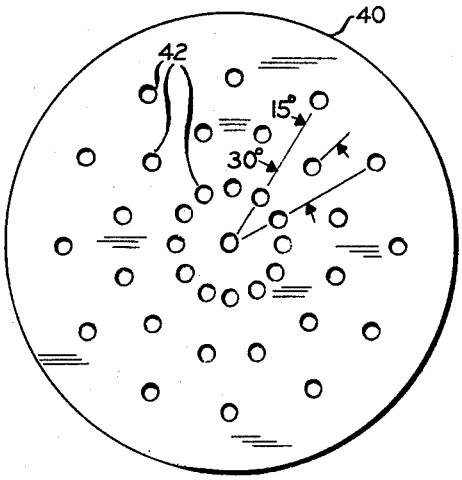
FIG. 3 is a top view of the distribution means shown in FIG. 1.

A spinneret assembly was constructed essentially as shown in FIGS. 1 to 4. The spinneret had 280 orifices 0.0177 in. (0.45 mm) in diameter. The spinneret plate was 0.750 inch (1.905 cm) thick and had a diameter of 5.780 inches (14.68 cm). The orifices in plate 36 were laid out as shown in FIG. 2 in which the radius of the circle of orifices was 1.25 inches (3.175 cm) and the orifices in plate 40 were laid out as shown in FIG. 3 in which the radius of the three circles of orifices were ¼, ½ and ¾ the radius of the plate, respectively, or 0.635 inch (1.83 cm), 1.445 inches (3.67 cm), and 2.1675 inches (5.505 cm), respectively. Both the plates 36 and 40 were the same diameter as the spinneret. The distance between plates 36 and 40 was 2 inches (5.08 cm) and the distance between plate 40 and the spinneret 22 was ¼ inch (0.635 cm). The orifices in both plates 36 and 40 were ⅛ inch (0.317 cm) in diameter.

In an effort to demonstrate the molten polymer flows through a spinneret assembly of the present invention substantially in "plug flow", the above described spinneret assembly was employed to spin polypropylene filaments. The polypropylene resin had a 4 melt flow and was unpigmented or natural in color. At time zero, while spinning unpigmented polypropylene, approximately 1 pound of red pellets of polypropylene was fed to the screw of the melt extruder. After 3 minutes and 10 seconds the filaments extruded through the 3 outside rings of orifices of the spinneret changed to a medium red color and the filaments from the orifices in the center of the spinneret were the natural color. After 4 minutes had passed, all the filaments were a dark red. After 6 minutes the color of all the filaments was turning to a lighter red, but all the filaments were the same color. The red color continued to lighten evenly until 13 minutes had elapsed at which time the filaments from the outside rings of orifices appears to be slightly lighter in color. After 17 minutes only the filaments from the inside rings of orifices appears to have a faint pinkish color.

This illustrates that the polymer was flowing through the area of the spinneret assembly designated as zone 48 of FIG. 1 essentially in "plug flow" and that the polymer was flowing through the orifices of the spinneret at substantially the same flow rate.

I claim:

1. A spinneret assembly comprising:

annular inlet means, distributor means, a spinneret, and means for positioning said annular inlet means, distributor means and spinneret in that order in spaced relationship wherein said annular inlet means is circular and has a plurality of equally spaced orifices positioned therein to generally define in circle having a center concentric with said annular inlet means and a radius ranging from about 25 to about 80 percent of the radius of said distributor means, and wherein said distributor means is circular and has a plurality of orifices positioned therein to generally define three concentric circles, each circle having a center concentric with said distributor means and the circumference of each circle intersecting the radius of said distributor means at points approximately equally spaced along the radius and between the center and the circumference of said distributor means, and the orifices defining each circle of said distributor means being equally spaced from each other.

2. The apparatus of claim 1 wherein the total cross-sectional area of orifices in the spinneret is larger than the total cross-sectional area of orifices in the distributor means which is larger than the total cross-sectional area of the orifices in the annular inlet means.

3. The spinneret assembly of claim 1 wherein the orifices in the annular inlet means are spaced from about 15° to about 60° apart, the distance between the annular inlet means and the distributor means ranges from about ¼ (0.635 cm) to about 6 inches (15.24 cm), and the distance between the distributor means and the spinneret ranges from about 1/16 inch (0.158 cm) to about 3 inches (7.62 cm).

4. The spinneret assembly of claim 1 wherein the plurality of orifices in said annular inlet means are elongated so as to generally define the shape of an annulus.

5. The spinneret assembly of claim 1 further comprising a fluid inlet connected to an inlet plenum which is connected to said annular inlet means.

6. The apparatus of claim 1 wherein the orifices in the annular inlet means are positioned to define a circle having a radius ranging from about 35 to about 65 percent of the radius of said distributor means, wherein the distance between the annular inlet means and the distributor means ranges from about ½ inch (1.27 cm) to about 2 inches (5.08 cm) and wherein the distance between the distributor means and the spinneret ranges from about 3/32 (0.238 cm) to about 1 inch (2.54 cm).

7. The apparatus of claim 6 wherein the orifices to the annular inlet means are circular, spaced 40° apart and ⅛ inch (0.317 cm) in diameter, the orifices in the distribution means are circular, 150 inch (0.317 cm) in diameter, and spaced 30° apart with respect to the orifices defining the same circle and approximately 15° apart with respect to the orifices defining adjacent circles, the distance between the annular inlet means and the distribution means is 2 inches (5.08 cm) and the distance between the distribution means and the spinneret is ¼ inch (0.635 cm).

* * * * *

UNITED STATES PATENT AND TRADEMARK OFFICE

CERTIFICATE OF CORRECTION

PATENT NO. : 4,104,015

DATED : August 1, 1978

INVENTOR(S) : Richard D. Meyer

It is certified that error appears in the above-identified patent and that said Letters Patent are hereby corrected as shown below:

Column 5, line 28, "in" should read --- a ---.

Column 6, line 12, after "1/4" insert --- inch ---; line 24, after "35" insert --- percent ---; line 31, after "orifices", "to" should read --- in ---; line 34, "150" should read --- 1/8 ---.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*